US005094413A

United States Patent [19]

Ripamonti

[11] Patent Number: 5,094,413

[45] Date of Patent: Mar. 10, 1992

[54] DEVICE FOR THE PROTECTION OF TRACK RELAYS FROM ELECTRICAL DISTURBANCES

[75] Inventor: Paolo Ripamonti, Genoa, Italy

[73] Assignee: Bailey Esacontrol S.p.A., Genoa, Italy

[21] Appl. No.: 417,902

[22] Filed: Oct. 6, 1989

[30] Foreign Application Priority Data

Oct. 26, 1988 [IT] Italy ..... 12574 A/88

[51] Int. Cl.[5] ..... B61L 21/08

[52] U.S. Cl. ..... 246/28 F; 246/34 R

[58] Field of Search ..... 246/28 F, 34 B, 34 A, 246/34 R; 307/522, 523, 524, 529; 328/139

[56] References Cited

U.S. PATENT DOCUMENTS

| | | | |
|---|---|---|---|
| 3,715,669 | 2/1973 | LaForest | 246/34 B X |
| 3,927,851 | 12/1975 | Wilcox | 246/34 R X |
| 3,958,781 | 5/1976 | Woods et al. | 246/34 R |
| 3,970,271 | 7/1976 | Auer et al. | 246/34 R |
| 3,986,691 | 10/1976 | Ehrlich et al. | 246/34 R |
| 4,065,081 | 12/1977 | Huffman et al. | 246/34 R |
| 4,089,495 | 5/1978 | Knight | 246/34 R |
| 4,188,002 | 2/1980 | Gilcher | 246/34 R |
| 4,349,170 | 9/1982 | Bilet et al. | 246/28 F X |
| 4,417,229 | 11/1983 | Wilson | 246/34 B |
| 4,432,517 | 2/1984 | Ripamonti | 246/28 F |
| 4,442,988 | 4/1984 | Laurent et al. | 246/34 R X |
| 4,494,717 | 1/1985 | Corrie et al. | 246/28 F |
| 4,535,959 | 8/1985 | Gilcher | 246/34 R |
| 4,582,279 | 4/1986 | Pontier | 246/34 B |

FOREIGN PATENT DOCUMENTS

| | | | |
|---|---|---|---|
| 2444251 | 3/1976 | Fed. Rep. of Germany | 246/34 R |
| 2445397 | 4/1976 | Fed. Rep. of Germany | 246/34 R |
| 2753419 | 5/1979 | Fed. Rep. of Germany | 246/34 R |

*Primary Examiner*—Robert J. Spar
*Assistant Examiner*—Scott L. Lowe
*Attorney, Agent, or Firm*—Robert E. Burns; Emanuel J. Lobato

[57] ABSTRACT

A device for protecting track relays from electrical disturbances originating from a train's traction current. The device has: a control signal generator; a signal inverter, to invert periodically the polarity of the signal emitted; and a receiver for the control signal. A distinguishing circuit is provided downstream from the receiver for assessing the frequencies forming the receive signal and switching the track relay to the "line clear" position only after recognition of the frequencies forming the periodically inverted control signal.

5 Claims, 4 Drawing Sheets

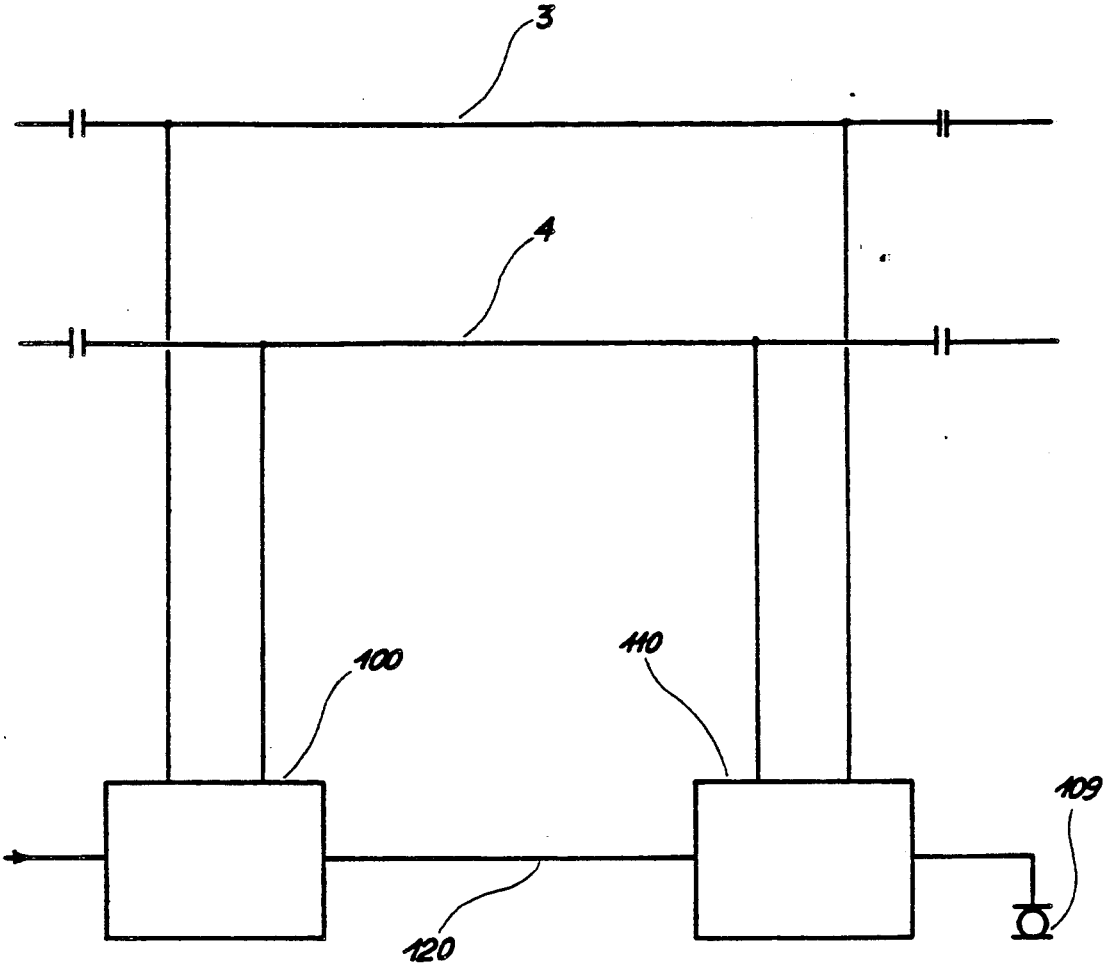
Fig. 2
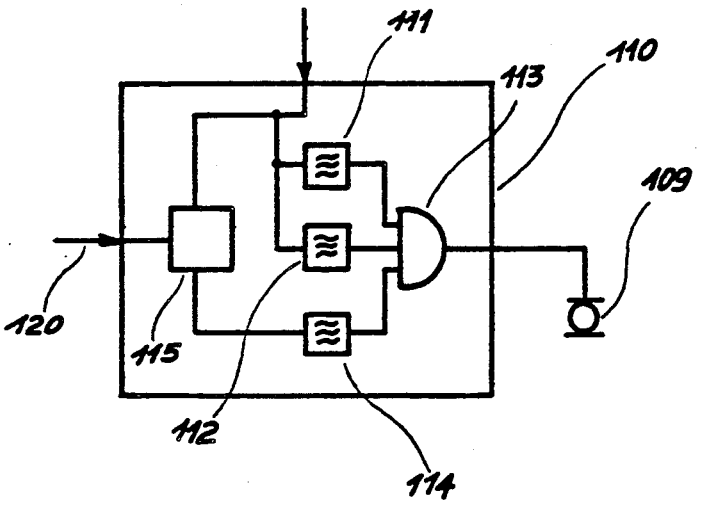
Fig. 2/Bis

DEVICE FOR THE PROTECTION OF TRACK RELAYS FROM ELECTRICAL DISTURBANCES

FIELD OF THE INVENTION

The subject-matter of this invention consists of a device for protecting track relays from electrical disturbances.

The invention is also applicable to the protection of electronic track relays.

The disturbances which the claimed device is capable of eliminating also include electrical vectors with characteristics indentical to those of the signal normally used to energize the track relay.

BACKGROUND OF THE INVENTION

It is well known for railway signalling purposes the rails are divided up into sections, each of which is inserted into a corresponding electrical circuit known as a track circuit.

As a rule, said track circuits have a signal emitter, generally located at one end of said sections of track, and a receiver for said signal, generally located at the other end of the section of track. If no rolling stock is present on the section of track in question, the receiver duly receives the signal transmitted by the emitter, and this reception is interpreted as "line clear" information.

If, on the other hand, rolling stock is present on the section of track, the axles of the locomotive or of the waggons being pulled by it short-circuit the track circuit, so that the receiver no longer receives the signal from the emitter, or receives a very different signal from the one received when the section of track is clear.

This second situation is interpreted as a "line not clear" signal.

The above, in principle, is how the known type of track circuit operates.

It should be pointed out, however, that traction current also circulates in the rails, and that sometimes said current may have harmonics similar, in terms of waveform, frequency and intensity, to the current transmitted to the track circuit by the emitter. Although it is improbable, it could arise that the receiver interprets as a "line free" signal a disturbing current which is part of the locomotive's traction current, and this is incompatible with the safety conditions demanded of a railway signalling system.

A previous invention by the same Owner (Italian patent no. 1.186.871), exploits the hypothesis of the disturbing signal from the traction current having characteristics of stability over a sufficiently long period of time, and therefore provisions are made to invert the polarity of the signal transmitted by the emitter with a higher frequency.

In this way it is possible, by means of a relatively simple alteration in the track circuit, to recognize a disturbance current with a frequency, waveform and phase similar to the current generated by the emitter, thus preventing any confusion between the disturbance and the signal, as the probability of this similarity being maintained even in the face of the inversion of the signal is practically null.

SUMMARY OF THE INVENTION

According to this invention, the control signal which feeds the track circuit is inverted periodically with a period (T), so that once again the hypothesis is exploited that the disturbance and the signal might remain identical for a certain period of time, but that this condition cannot persist for a longer time.

However, instead of comparing the time sequence of the control signal with a similar signal present locally, a frequency analysis of the control signal reaching the receiver is conducted, so as to drastically reduce the possibility of confusing a disturbing signal with the actual control signal.

Indeed, it should be pointed out that in terms of spectrum analysis, an inversion of polarity of a sinusoidal signal at suitable intervals causes the spectrum to be transformed from a simple "needle" spectrum to a lobed spectrum, the characteristics of which are closely related to the period of the starting sine wave and to the period of inversion of the signal. While the information content of the signal is maintained in its entirety, the comparison between the two spectra of the disturbing and control signals is simplified and more reliable.

BRIEF DESCRIPTION OF THE DRAWINGS

FIG. 2 shows schematically the device according to this invention, and which is an improvement on the device shown in FIG. 1;

FIG. 2A is an enlargement of the detail indicated by 110 in FIG. 2;

DETAILED DESCRIPTION OF A PREFERRED EMBODIMENT

Figure 1:
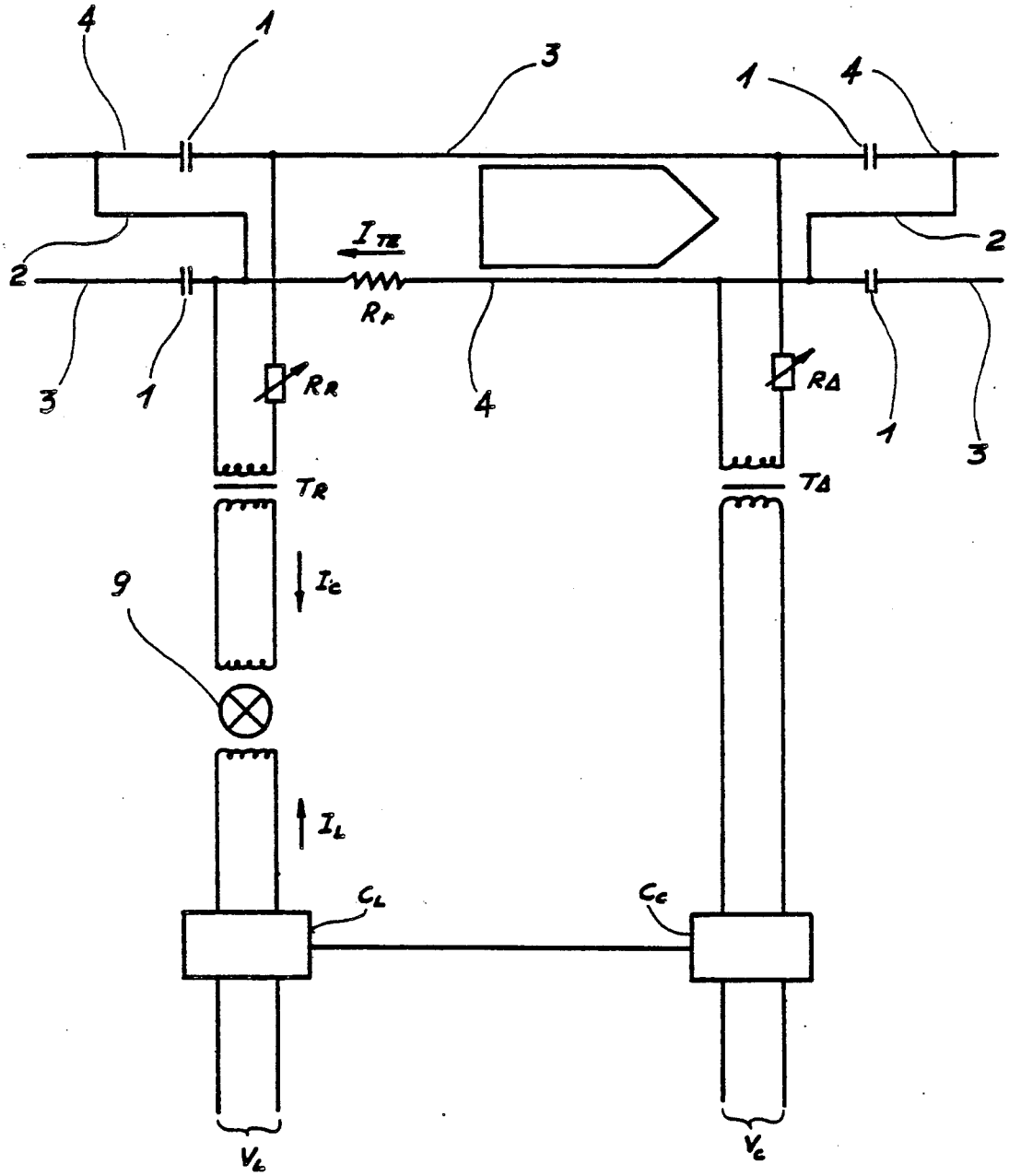
FIG. 1 shows a track circuit implemented according to the previous invention of the same Owner, covered by Italian patent no. 1.186.871.

FIG. 1 is a traditional track circuit: 1 indicates the insulated joints separating electrically the various segments of rail of each separate section, while 2 indicates electrical connections, of the so-called "Z" type, guaranteeing electrical continuity between the non-insulated parts of the various sections of rail.

In the same figure, 3 indicates the insulated parts and 4 the non-insulated parts.

Insulation of the rail makes it possible to create the track circuit. By applying a voltage between the insulated rail 3 and the ground rail 4, it is possible to keep a track relay 9 energized, as long as no rolling stock axle is physically located within the track circuit; when an axle is present, the track relay is de-energized since the axle short-circuits the supply voltage of the track relay 9; in this way the information is received that the track circuit is occupied by a rolling stock axle (track circuit "not clear"). Together with the Z-type connections 2, the ground rails 4 allow return of the traction current to the electrical sub-stations.

In this type of circuit, therefore, the traction current runs alternatively through one or the other rail of the pair.

$R_R$ and $R_A$ indicate the adjustment resistors which control the supply and receive voltages respectively of the track circuit $V_C$ and $V_L$, also known as field voltage and local voltage.

$T_R$ and $T_A$ indicate the receive and supply transformers respectively. These insulate galvanically the track circuit from the cab electric circuits; the availability of adjustment taps allows easy adaptation of the supply and receive voltages to the characteristics of the different track circuits.

The information which can be obtained from the track relay 9 is the following:

relay energized: the track circuit is clear, that is to say there is no rolling stock present on the section of track in question;

relay de-energized: rolling stock is present in the track circuit.

It should be noted that the condition of the track relay 9 is not related only to the value of the voltages applied to the windings.

The torque (C) acting on the mobile equipment of the relay depends on the currents $I_L$ and $I_C$ (local and field current) as per the following formula:

$$C=K * I_L * I_C \sin(\text{alpha})$$

where (alpha) is the phase displacement angle between the two currents and K is a constant depending on the type of relay.

Said torque is a its highest, in the sense of energizing the relay, when the current $I_C$ is 90° ahead of the current $I_L$.

These alternating currents are derived from the same power source, since they must be strictly synchronous. Suitable arrangements can be made to achieve the phase displacement required for correct operation of the track relay.

This can be achieved, for instance, by branching off the two voltages from the phases of a three-phase triad and/or inserting a suitable capacitor.

Lastly, $R_R$ is the resistance of the ground rail 4.

As stated above, when the track circuit is occupied by rolling stock, for example a locomotive, as shown in FIG. 1, track relay 9 is de-energized, since the axles of the locomotive short-circuit the track circuit.

The de-energized condition of the relay 9 is used as a signal that the section of rails forming the track circuit is not clear, and this signal is used to prevent access to the same track circuit of other rolling stock, in order to avoid collisions.

In some cases, however, even when rolling stock is present within the track circuit, undesired energizing of the relay 9 might be possible, with the consequent potential danger.

This is because in spite of the presence within the track circuit of rolling stock short-circuiting the supply current generated by $V_A$, the relay 9 might be in an energized condition, if the following circumstances should occur:

the resistance $R_R$ of the ground rail reaches a sufficient value the locomotive transmits a disturbing current $I_{TE}$ at a frequency of 50 Hz, with a suitable phase as compared to the local voltage $V_L$.

The solution put forward in the previous invention by the same Owner and already mentioned above consists of inserting polarity switching devices between the track relay 9 and the local voltage $V_L$ on one side, and between the track circuit supply voltage and the field voltage $V_C$ on the other.

According to said invention, the polarities of the local voltage $V_L$ and and the field voltage $V_C$ are inverted periodically by means of switching devices $C_C$ and $C_L$.

According to this invention, as indicated schematically in FIG. 2, the sinusoidal signal (as a rule at 50 Hz) is still tampered with by periodically inverting it (for example every 40 m.sec.).

But in this instance, according to this invention, the spectrum of the signal is examined, which means examining the amplitude value and possibly the phase of a limited number of harmonics.

The periodic inversion of the sinusoidal signal at the train's power frequency causes a periodic signal to be generated, formed by a precise number of harmonics at the assigned frequencies, but excluding—and this is important—the frequency of the signal which was inverted.

The treatment of the signal entails a ciruit of periodic inversion of the polarity of the signal (for example every 40 m.se), indicated by 100 in FIG. 2. The modulated signal entering the receiver 110 no longer consists of a signal having a frequency $F_o=50$ Hz, but of several frequencies:

$$f_n=F_o\pm(2n-1) * f_i \; n=1, 2, 3 \ldots$$

where $f_i$ is the inversion frequency.

Recognition of the incoming signal is therefore achieved by checking the presence of these frequencies and of their corresponding amplitudes.

It is possible to increase still further the safety of the check by arranging to invert once again the signal received, in a synchronous manner, through line 120 shown in FIG. 2, and then checking it for the presence of the frequency $F_o$; this is possible only if said frequency is absent from the input signal.

In its most simple configuration, the device, as shown in FIG. 2, consists of an in-transmission polarity inverter 100 and two filters 111 and 112 tuned to the sidebands of the spectrum of the incoming signal. The outputs from these filters feed an AND circuit 113 which in turn feeds a neutral relay 109.

It is possible, of course, to increase the signal/disturbance ratio of the incoming signal by increasing the number of frequencies detectable in the input. As an alternative, as shown in FIG. 2A, a third filter 114 can be added, preceded by an inverter 115, so as to demodulate and check the presence of the frequency $F_o$.

If the frequency of the starting sinusoidal signal is the same as the train's main power frequency, that is to say 50 Hz, and if the inversion period is 40 m.sec, filters 111 and 112 will have to be tuned to the frequencies of 62.5 and 37.5 Hz respectively.

Filter 114, on the other hand, will of course have to be tuned to a frequency of 50 Hz.

Figure 3:
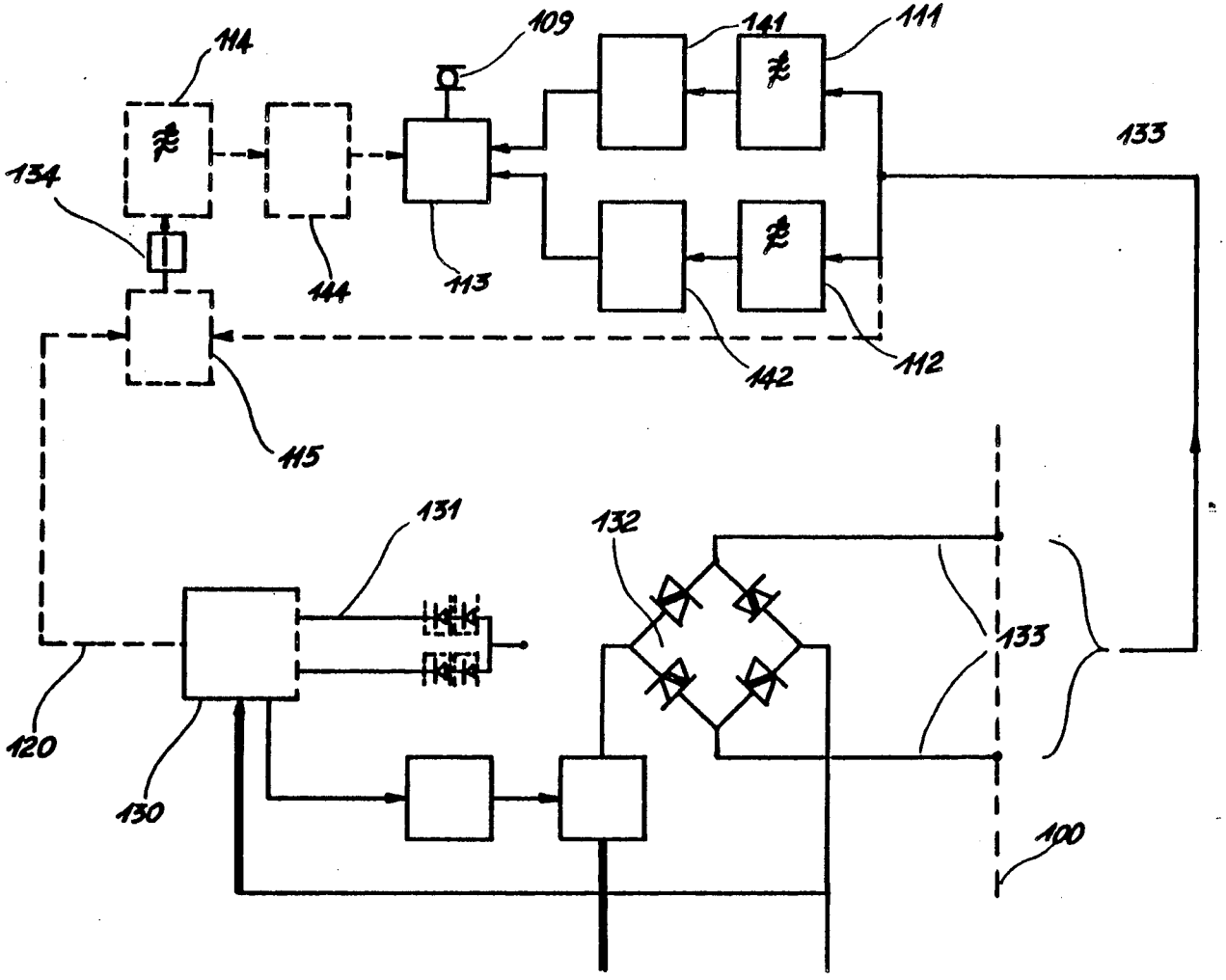
FIG. 3 shows in greater detail the same device illustrated in FIG. 2.

FIG. 3 illustrates in greater detail the same device shown in FIG. 2: the components of the inverter 100 include an inversion frequency generator 130 which generates a square wave 131 by means of which the sinusoidal voltage $V_A$ is conditioned, with the aid of bridge circuit 132.

The signal sent to the track circuit is indicated by 133. Note that the inversion frequency generator also sends the synchronzing signal 120 to the inverter 115, which reconstructs in 134 the 50 Hz sinusoidal signal to be sent to the filter 114 located upstream from the AND gate 113.

On the other side, the signal 133 from the track circuit is sent to the two filters 111 and 112 and then, through the same AND gate 113 to the neutral relay 109. The threshold detectors 141, 142 and 144 complete the layout of the device.

Figure 4:
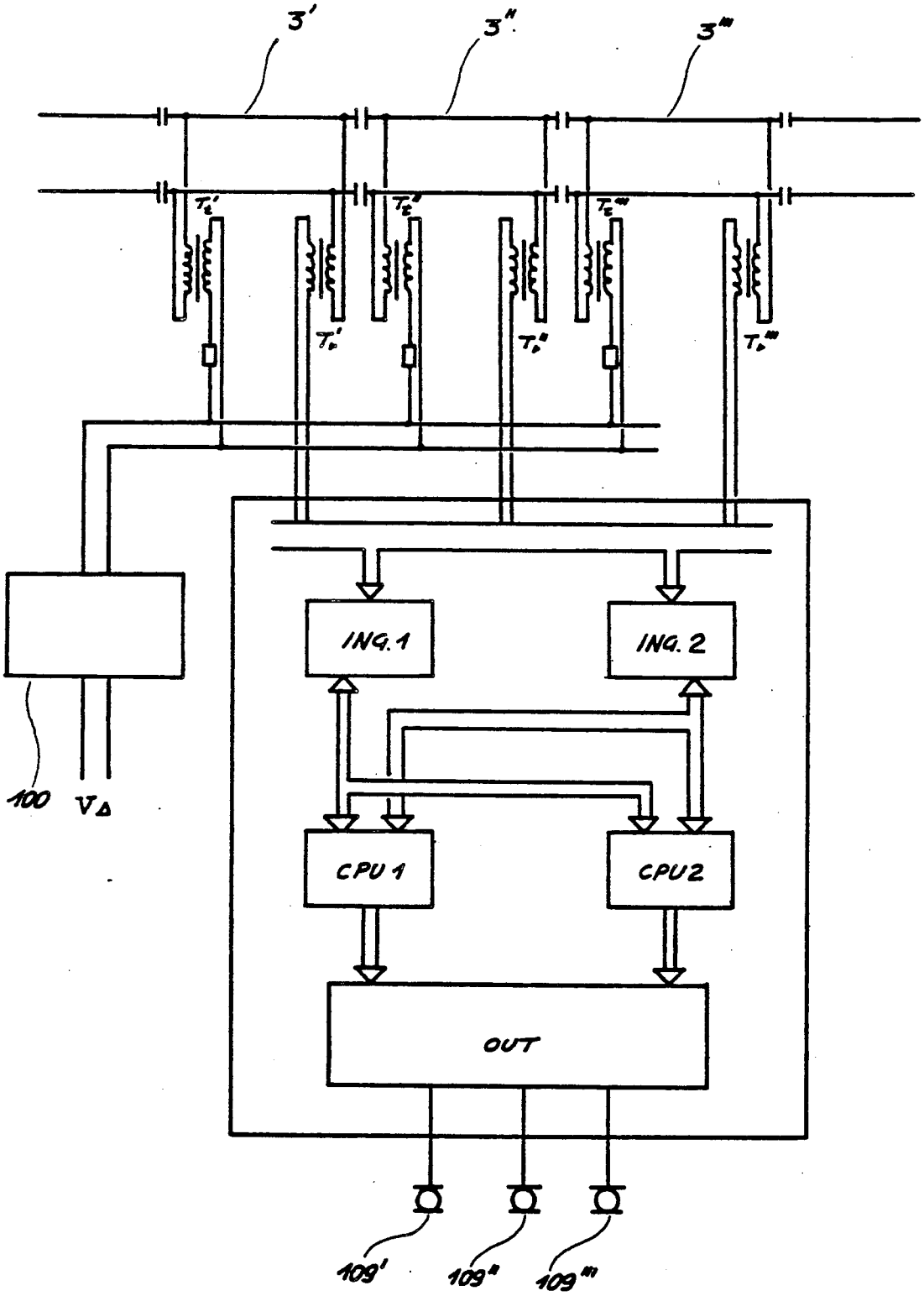
FIG. 4 illustrates a variant in the embodiment of the invention.

As illustrated in FIG. 4, a variant of the device claimed can embody programmed-logic circuits in "2-out-of-2" or "2-out-of-3" configurations, entrusting detection of the transmitted signal, suitably inverted, to recognition of the sidebands of the spectrum.

In said FIG. 4 the following can be seen: track circuit sections 3', 3'' and 3''', the transmit track transformers ($T_t$), the receive track transformers ($T_r$), the inverter 100 of the voltage ($V_A$) and the track relays at the various sections, 109', 109'' and 109'''.

Instead of the filters 111 and 112 and the thresholds 141 and 142, two processing units CPU1 and CPU2 are used, connected to two inputs ING1 and ING2, which the signals from the various track circuit sections reach in parallel.

The two processing units CPU1 and CPU2 send the analyzed signals to the above relays through an output element indicated as OUT in the figure.

I claim:

1. Device for the protection of track relays from electrical disturbances originating from a traction current, comprising;

a generator of a sinusoidal control signal with assigned frequency, equal as a rule to a train's main power frequency, located at a start of a section of a track circuit;

a signal receiver, located at an end of the track circuit section, upstream from a track relay, and which places the track relay in the "line clear" position when it receives said signal;

a signal inverter, inserted downstream from the transmitter, to invert periodically the polarity of the signal emitted, thus modulating the signal, and which is characterized by the fact that downstream from said receiver there is provided means for assessing the frequencies forming the receive signal which place the track relay in the "line clear" position only after recognition of the frequencies forming the periodically inverted sinusoidal signal.

2. Device for the protection of track relays from electrical disturbances originating from the traction current according to claim 1, characterized by the fact that said signal inverter located downstream from the transmitter is connected to the receiver by a synchronizing signal transmission line which ends at a second polarity inverter and modulator located upstream from said receiver, in order to check also the presence of the frequency of the starting sinusoidal signal.

3. Device for the protection of track relays from electrical disturbances originating from the traction current according to claim 1 or 2, characterized by the fact that said means for assessing the frequencies forming the receive signal consist of at least two filters tuned to the frequencies:

$$f_n = F_o \pm (2n-1) * f_i \quad n = 1, 2, 3 \ldots$$

where $f_i$ is the inversion frequency and $f_o$ is the frequency of the periodically inverted sinusoidal signal, in which an AND gate to control the condition of the track relay is inserted downstream from said filters.

4. Device for the protection of track relays from electrical disturbances originating from the traction current according to claim 3, characterized by the fact that upstream from said AND gate and parallel to said filters there is another filter, tuned to the frequency of the starting sinusoidal control signal and fed by the second inverter.

5. Device for the protection of track relays from electrical disturbances originating from the traction current according to claim 1, characterized by the fact that the signal from the track circuit and the signal from the inverter and modulator, feed processing units which are capable of frequency analysis of these signals and, depending on their meeting preestablished spectrum characteristics, operate the track relay correspondingly.

* * * * *